United States Patent [19]

Frazer

[11] Patent Number: 4,607,810

[45] Date of Patent: Aug. 26, 1986

[54] PASSIVE CONSTRAINT FOR AERODYNAMIC SURFACES

[75] Inventor: Alson C. Frazer, Santa Ana, Calif.

[73] Assignee: Ford Aerospace & Communications Corporation, Detroit, Mich.

[21] Appl. No.: 689,351

[22] Filed: Jan. 7, 1985

Related U.S. Application Data

[62] Division of Ser. No. 472,891, Mar. 7, 1983, Pat. No. 4,523,728.

[51] Int. Cl.[4] ..... F42B 13/32

[52] U.S. Cl. ..... 244/329; 206/497

[58] Field of Search ..... 244/3.24–3.3; 102/529; 206/497

[56] References Cited

U.S. PATENT DOCUMENTS

| | | | |
|---|---|---|---|
| 3,853,288 | 12/1974 | Bode | 244/3.29 |
| 4,242,960 | 1/1981 | Boeder et al. | 102/529 |
| 4,289,237 | 9/1981 | Cutrara | 206/497 |

*Primary Examiner*—Deborah L. Kyle
*Assistant Examiner*—Michael Carone
*Attorney, Agent, or Firm*—Edward J. Radlo; Robert D. Sanborn

[57] ABSTRACT

In a guided projectile such as a missile, it is often necessary to negate the lift force imparted by the wings (5) during early low velocity stages of flight. Thus, wings (5) can be flattened against the airframe (2) of the missile (1) by a passive constraint, e.g., a shrink tubing (35) which disintegrates due to aerodynamic heating at a higher velocity stage of the flight, allowing each wing (5) to deploy into a position generally orthogonal to the airframe (2). The deployment force can be provided by torsionally and compressionally preloaded springs (19).

1 Claim, 8 Drawing Figures

PASSIVE CONSTRAINT FOR AERODYNAMIC SURFACES

DESCRIPTION

This is a divisional application of application Ser. No. 472,891, filed Mar. 7, 1983, now U.S. Pat. No. 4,523,728.

TECHNICAL FIELD

This invention pertains to the field of guided moving warheads, which may be either missiles or projectiles, in which an internal penetrator rod is present to maximize the destructiveness of the warhead. Such a warhead is sometimes referred to as a "long rod penetrator".

BACKGROUND ART

A prior art search was performed and disclosed the following U.S. patent references:

U.S. Pat. No. 3,098,446 discloses a ring 27 which holds wings of a missile in place. Ring 27 is physically removed before the missile is launched, unlike in the present invention where constraint 35 is passively disintegrated subsequent to launch by the effects of aerodynamic heating.

U.S. Pat. No. 3,174,430 shows dished plate 18 for restraining rocket wings. The plate is blown off by pressure from the rocket blast, not by aerodynamic heating as in the present invention.

U.S. Pat. No. 3,756,602 discloses an arrow with vanes that are fixed with respect to the shaft of the arrow, not gimballed wings as in the present invention. The aerodynamic problems faced by archers are different than in the technical field addressed by the present invention, because in archery the velocity of the crossflow is not a linear function of the velocity of the relative wind.

U.S. Pat. No. 3,946,638 discloses sleeve 26 which holds rocket fins closed prior to launch. Sleeve 26 is left in the launch tube during launch and thus is not passively removed subsequent to launch by aerodynamic heating as is constraint 35 in the present invention.

U.S. Pat. No. 4,198,016 shows two pivotable canards 12 positioned on the outside of an underwater missile. The missile does not have a penetrator rod as in the present invention. The canards serve to create a counterforce on the nose of a missile by making an angle of attack with the relative "wind". The present invention optionally aligns wings to form an angle of attack with respect to the crossflow, but not with respect to the relative wind; and the wings are coupled to a penetrator rod.

Elongated penetrator rods such as rod 3 of the present invention have been used in the design of weapon systems for the perforation of armor plate. The parameters of primary importance in such a penetrator rod are: the specific energy placed upon the target surface and the degree of alignment of the rod's principal axis with the velocity vector of flight. The first of these parameters is optimized by designing the rod to have a high length-to-diameter ratio. The second parameter, alignment, becomes more critical as the length-to-diameter ratio increases. Tests have revealed that the alignment effects are severe: that is, a very small misalignment can result in a large reduction in target material penetration.

Long rod penetrator devices have been deployed on projectiles fired from a high velocity gun. In this non-guided application, the rod is structurally supported by a sabot while in the gun barrel, but flies free upon emergence. The rod is provided with some suitable aerodynamic surface, such as fins or a flared base, forming an aerodynamically stable airframe. The free unguided flight is accomplished, therefore, with near perfect alignment of the rod's principal axis and its velocity vector. Angular errors due to crossflow and/or target motion are intrinsically present, but are nominally very small due to the high projectile velocities typically involved (4000 to 5000 feet per second).

Beginning with the late 1970's, guided warheads (both missiles and projectiles) employing long rod penetrators as a lethal device have emerged. Typically, the penetrator is made integral with the structure of the warhead's airframe, and aligned with the longitudinal axis of the airframe. The airframe, in order to respond to guidance error commands, must develop a velocity vector component that is orthogonal to the uncorrected velocity vector of the warhead. This cross velocity may, but not necessarily, involve an attitude change as well; as a result, the airframe longitudinal axis may not be aligned with either the uncorrected velocity vector or the corrected velocity vector. As the penetrator principal axis and the airframe longitudinal axis are congruent, the penetrator may be misaligned with the corrected velocity vector. As a result, the performance of the warhead is sharply degraded.

Allowing an aerodynamically stable guided warhead to become unguided during the last period of flight can remove the guidance-error-induced misalignment of the rod, but at the expense of terminal accurancy and system complexity needed to determine the time of ballistic flight conversion.

The above problems are remedied by the present invention.

DISCLOSURE OF INVENTION

In a first aspect of the present invention, apparatus causes an elongated penetrator rod (3) situated within a guided warhead (1) to align with the net, true velocity vector of the mass centroid of the warhead (1), i.e., the rod (3) points into the relative wind of the moving warhead (1). As used herein, the "relative wind" is a vector equal in magnitude and opposite in direction to the velocity vector of the warhead (1).

Two pairs of aerodynamically stable wings (5) are pivotally mounted on the airframe (2) of the warhead (1). The first pair of wings (5) pivots about a first axis; the second pair of wings (5) pivots about a second axis orthogonal to the first axis. The wings (5) are coupled to the penetrator rod (3) by means of a two-axis gimbal (7) which grasps the rod (3) near its midpoint, wherein the two orthogonal axes of the gimbal (7) are aligned with each of said aforementioned axes. Thus, the front part of the rod (3) is free to travel unrestrictedly within a region in the shape of a cone within the front interior of the warhead (1).

During the warhead's flight, aerodynamic forces on the wings (5) align the wings (5) with the relative wind of the warhead's mass centroid. This in turn causes rod (3) to align with the velocity vector of the mass centroid of the warhead (1) as desired.

Gears are optionally installed in the pivot shafts (11, 15) coupling the wings (5) to the gimbal (7), to compensate for the effects of crossflow on the wings (5) caused by the shape of the warhead (1). If present, this crossflow will be small and linear compared with the relative wind, and therefore fixed gear ratios can be used.

Warhead (1) can be either a missile or a projectile. As used herein, a "missile" carries its own propulsion means, is launched at a relatively slow velocity, and has the capability of increasing velocity subsequent to launch. A "projectile" is launched from a gun or tube at a relatively high velocity, does not carry its own propulsion means, and does not have the capability to increase velocity subsequent to launch.

In the case where warhead (1) is a guided missile, it is desirable to keep the wings (5) folded flat against the airframe (2) of the missile (1), or otherwise retracted, during initial stages of flight, so that unwanted lift-induced pitching moments will not be introduced. The wings (5) are constrained by means of a passive constraint (35), e.g., a partially cured shrink tubing which further shrinks to the point of tensile failure in response to aerodynamic heating during a subsequent higher velocity stage of the flight, thereby allowing the wings (5) to deploy to their operating position generally orthogonal to the airframe (2). This aspect of the present invention may be utilized independently of the first aspect, in any situation where it is necessary or desirable to passively deploy aerodynamic surfaces during a high velocity phase of the missile's or projectile's flight.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

Figure 1:
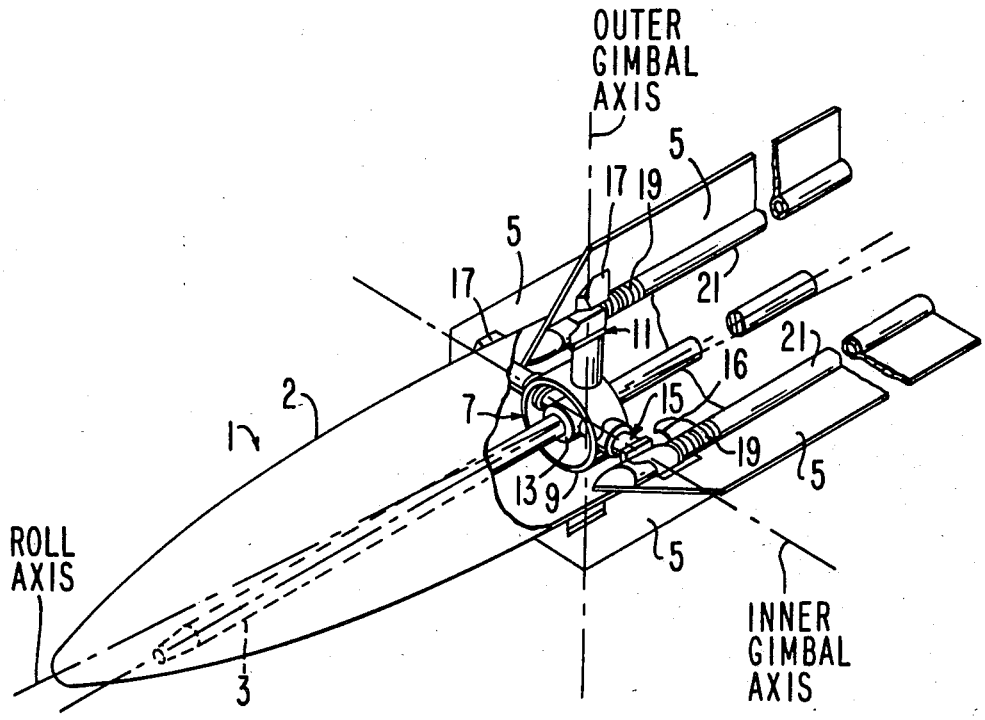
FIG. 1 is an elevated view, partially broken away, of a warhead 1 employing the present invention.

The criteria for the composition of rod 3, in order of importance, are that it have a high density, a high compressive strength, and a high shear strength. Thus, rod 3 is typically made of tungsten carbide or the more plentiful depleted uranium.

Gimbal 7 grasps rod 3 at or near the center of mass of rod 3, so as to minimize moments attributable to rod 3, thereby retaining the desired passivity of the system. Gimbal 7 is a two-axis gimbal, wherein an inner pivot shaft 15 pivots about a first axis and an outer pivot shaft 11 pivots about a second axis orthogonal to the first axis. Each of these two axes is constrained to be orthogonal to the longitudinal (roll) axis of warhead 1 by means of a mounting collet (not illustrated) surrounding gimbal 7 and fixedly mounted within warhead 1. The inner gimbal shaft 15 rigidly couples to penetrator rod 3 by means of inner cylindrical sleeve 13. The outer pivot shaft 11 rigidly couples to inner pivot shaft 15 at two regions by means of outer cylindrical sleeve 9.

The inner pivot shaft 15 protrudes through the wall of airframe 2 via a pair of elongated slots 16, each of whose longitudinal axis is aligned with the roll axis of warhead 1. The outer pivot shaft 11 protrudes through the wall of airframe 2 via a pair of circular slots 12 (see FIG. 3*a*).

Two elongated wings 5, on opposing sides of airframe 2, are fixedly mounted to inner shaft 15, thus constituting a first airfoil. An additional two elongated wings 5, on opposing sides of airframe 2, are fixedly mounted to outer shaft 11, thus constituting a second airfoil orthogonal to the first. Each wing 5 has an elongated, substantially flat, shape with a pointed forebody to minimize wind drag.

Rotation of warhead 1 about its roll axis does not adversely affect performance of the alignment wings 5 because the rotational forces are additive on one side of warhead 1 while subtractive on the other. Thus, the forces are balanced on each airfoil and the alignment wings 5 can function independently of rotational speed or even rotational acceleration of warhead 1.

The aerodynamic center of pressure of each wing 5 should be well aft of said wing's pivot shaft (11 or 15), to maximize the ability of the wing 5 to align with the relative wind. Lengthening wings 5 maximizes this desirable aerodynamic effect, but also undesirably increases the effect of any crossflow. "Crossflow" as used herein means a deviation in the relative wind caused by the shape of the forward section of warhead 1. The magnitude of the crossflow is a function of the shape of warhead 1, and the location of the centers of pressure on each of the wings 5 relative to the wing's pivot shaft (11 or 15). If crossflow is present, penetrator rod 3 tends to point into the relative wind as deviated by the crossflow. It is desired to remove this deviation if it is too large. The deviation may be very small because warhead 1 is moving very fast, and therefore, the magnitude of the relative wind is very high. However, when aerodynamic tests on a newly-designed warhead 1 show that the crossflow is expected to be troublesome, it can and should be compensated for, e.g., by the apparatus and method described herein.

When present, the magnitude of the crossflow velocity is typically small and substantially a linear function of the magnitude of the velocity of the relative wind. That component of the crossflow which is orthogonal to the wings 5 is the troublesome component and should be compensated for. This can be accomplished by gearing the inner and outer pivot shafts 15, 11, so that each pivot shaft has a first gear associated with the gimbal 7 and a second gear associated with a wing 5. The gear ratio is set to be equal to the anticipitated substantially constant ratio of the magnitude of the relative wind to the magnitude of that component of the crossflow orthogonal to the wing 5, as determined empirically prior to launch, e.g., by wind tunnel studies. The gearing is arranged so that this component of the crossflow will produce an equal but opposite force on the penetrator rod 3. Thus, rod 3 points into the true relative wind, as desired, and not into the relative wind as deviated by the crossflow.

The front portion of penetrator rod 3 can assume any position with a cone whose apex is coincident with the midpoint of gimbal 7. Since the angle of this cone is usually just a few degrees because of size constraints within warhead 1, it is possible, particularly at initial stages of the warhead's flight, that the mission maneuver angle (angle between the roll axis of warhead 1 and its velocity vector) is greater than the angle of this cone. Thus, the airfoils are in a "hardover" position, i.e. rod 3 is forced against an interior wall of warhead 1, and the airfoils produce a destabilizing lift force that is undesired.

In the case where warhead 1 is a missile, means can and should be employed to constrain the wings 5 in a retracted position during initial phases of the missile's flight when hardover is expected to occur, while allowing the wings 5 to deploy during subsequent phases of the flight when hardover is not expected to occur. For reasons of simplicity, this constraint means is preferably passive. The means illustrated herein to accomplish this is a band of shrink tubing 35, e.g. a polyimide.

Figure 2:
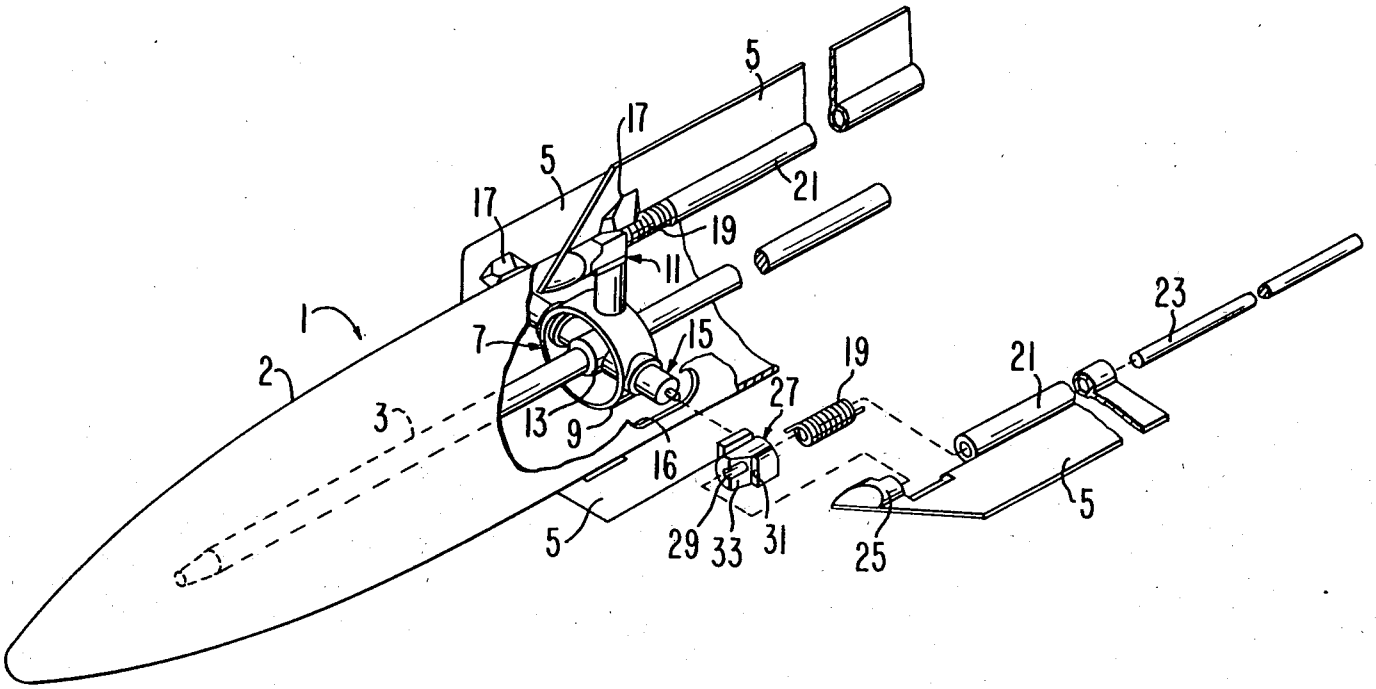
FIG. 2 is a view similar to that of FIG. 1 in which one of the wings 5 has been exploded so as to better illustrate means for deploying said wing 5.

FIG. 2 shows details for deploying wings 5. A stop 17 is attached to one side of each wing 5 so that when wing 5 is retracted flat against the outside of missile 1, stop 17 rests against the termination of the associated pivot shaft (11 or 15). A deployment spring 19 enables wing 5 to deploy to a position wherein its major surface is substantially orthogonal to the airframe 2. Spring 19 is preloaded both torsionally and compressionally. The torsion imparts the required 90° rotation to wing 5, while the compression pushes wing 5 backwards to lock it into place.

Spring 19 is held in place by rotation pin 23, a long cylindrical pin fitting within pin housing 21, spring 19, and front housing 25. Front housing 25 mates with an engagement housing 27 rigidly attached to an outer end of each pivot shaft 11, 15. The surface of engagement housing 27 which mates with front housing 25 has a front stop 29, an engagement ramp 33, and a backstop 31. This geometry is mimicked on front housing 25. The purpose of engagement ramp 33 is to soften the blow between housings 25 and 27 when wing 5 is locked back into place by the compressional force from spring 19.

Figure 3A:
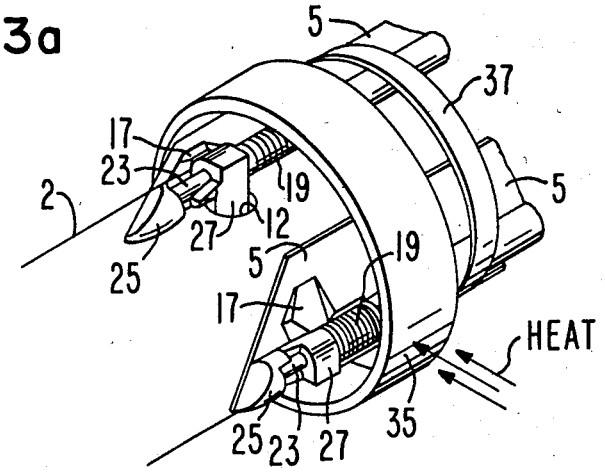
FIGS. 3*a* through 3*f* illustrate six sequential steps describing the folding of wings 5 against the airframe 2 of missile 1 prior to launch, and the subsequent deployment of the wings 5 during flight in response to aerodynamic heating.
Figure 3B:
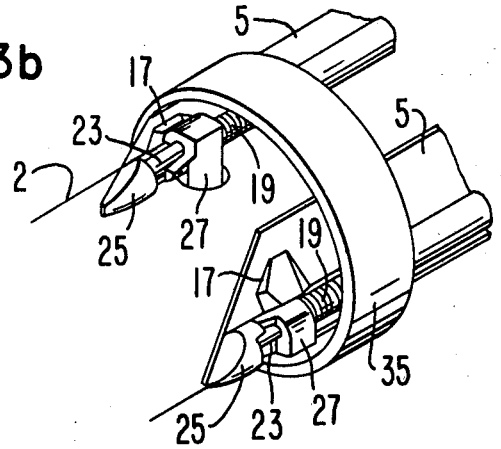

In FIG. 3*a*, the wings 5 are flattened against the airframe 2 and temporarily held in place by band 37. Shrink tubing 35, in a precured and thus preshrunk state, is then passed over a region of missile 1 where wings 5 are present. The diameter of the preshrunk tubing 35 is slightly greater than that of the missile 1 plus folded wings 5. Enough heat is then applied to shrink tubing 35 (FIG. 3*a*) so that tubing 35 undergoes a chemical crosslinking process which causes it to become smaller in diameter, so that it fits snugly over the wings 5, keeping them in a folded position. Temporary band 37 is then removed (FIG. 3*b*).

Figure 3C:
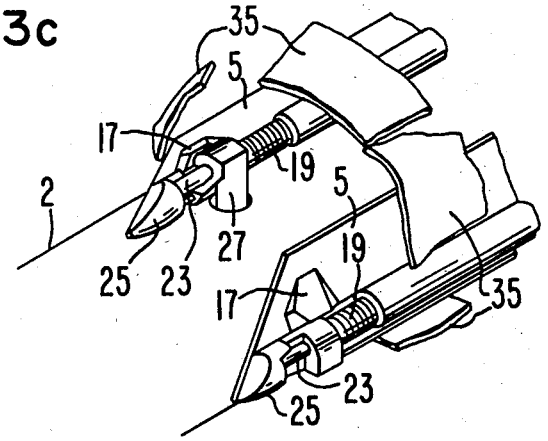
Figure 3D:
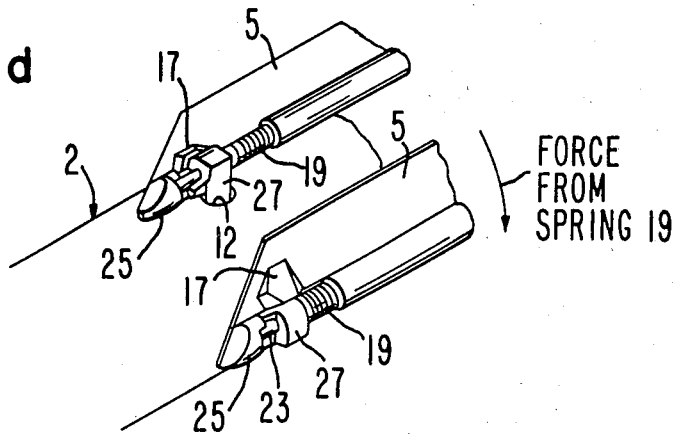
Figure 3E:
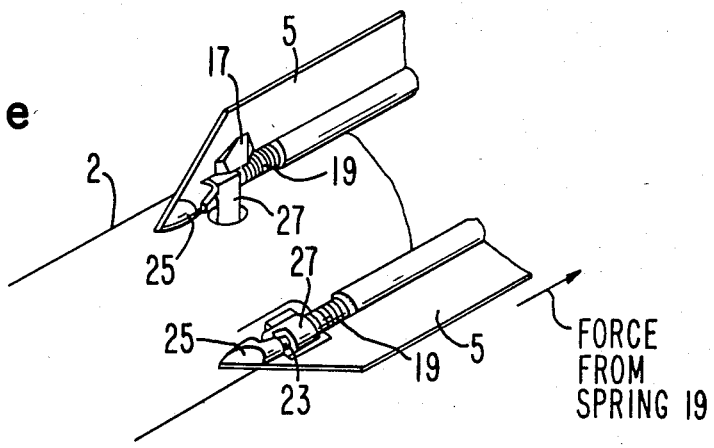
Figure 3F:
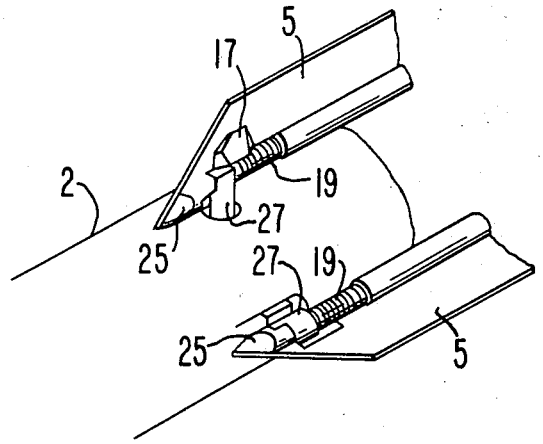

During a high velocity stage of the flight of missile 1, aerodynamic heating and drag causes shrink tubing 35 to further shrink to the point of tensile failure (FIG. 3*c*), since the diameter of tubing 35 has been preselected to be smaller than the diameter of missile 1 at full shrinkage. Upon the disintegration of tubing 35, wings 5 self-erect due to the torsional release of springs 19 (FIG. 3*d*) causing wings 5 to rotate 90°, and the compressional release of springs 19 (FIG. 3*e*) causing wings 5 to push back and lock into operational position (FIG. 3*f*).

The characteristics of shrink tubing 35 must be preselected so that tubing 35 will fail at the appropriate point in the flight. This is done, using known relationships between temperature and missile 1 velocity, by empirically choosing a composition for tubing 35 whose experimental range of failure is such that the low velocity end of the range is above the velocity of safety, and the high velocity end of the range is below the expected terminal velocity of missile 1, with built-in margins of safety. The "velocity of safety" is that velocity above which hardover is no longer possible. A typical margin of safety at the high end is a velocity range corresponding to a time that will allow ten initial oscillations of penetrator rod 3. These initial oscillations following release from the hardover position are damped by the damping inherent in gimbal 7.

The apparatus and method described herein for passively restraining the wings 5 is not limited to the case where the missile 1 employs a penetrator rod 3; this apparatus and method can be used in any case where it is necessary or desirable to passively deploy aerodynamic surfaces during the flight of a missile or projectile upon the attainment of a high velocity thereof. The retracted position of the aerodynamic surfaces does not have to be a flat placement along the airframe of the missile or projectile as illustrated in detail herein, but rather could be any other type of retraction, e.g., the aerodynamic surfaces could be orthogonal to the airframe of the missile or projectile but embedded within the interior of the missile or projectile via slits formed in said airframe.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. Passive constraint apparatus for holding aerodynamic surfaces of an airframe in a retracted position with respect to a generally tubular outer surface of the airframe during an initial, relatively low velocity, phase of the airframe's flight, while permitting deployment of the aerodynamic surfaces into a position generally orthogonal to the airframe's outer surface during a subsequent, relatively high velocity, phase of the airframe's flight, said passive constraint apparatus comprising:

less than totally cured shrink tubing which holds the aerodynamic surfaces retracted during said initial phase, wherein the diameter of the shrink tubing, when totally cured, is significantly less than the cross-sectional diameter of said airframe outer surface; whereby during said subsequent phase the shrink tubing attempts to shrink to its totally cured diameter but is prevented from doing so by said airframe outer surface, causing tensile failure in the shrink tubing and thereby permitting deployment of the aerodynamic surfaces.

* * * * *